US012286270B2

(12) United States Patent
Hutterer et al.

(10) Patent No.: US 12,286,270 B2
(45) Date of Patent: Apr. 29, 2025

(54) TRANSPORTING PACKAGING UNITS

(71) Applicants: Gerresheimer Glas GmbH, Düsseldorf (DE); Stevanato Group S.p.A., Piombino Dese (IT)

(72) Inventors: Nicole Hutterer, Wackersdorf (DE); Andreas Fraas, Amberg (DE); Ricardo Colchado, Corregidora (MX); Stephen Flynn, Peachtree City, GA (US); Braden Miller, Havertown, PA (US); Scott Rosenman, Mount Laurel, NJ (US); Alessio Bonati, Cadoneghe (IT); Michele Guasti, Treviso (IT); Marco Canestraro, Carmignano di Brenta (IT); Riccardo Prete, Ponte San Nicolo (IT); Gianpaolo Bertolin, Noale (IT); Michael-Martin Strehl, Pfreimd (DE)

(73) Assignees: Gerresheimer Glas GmbH, Düsseldorf (DE); Stevanato Group S.p.A., Piombino Dese (IT)

( * ) Notice: Subject to any disclaimer, the term of this patent is extended or adjusted under 35 U.S.C. 154(b) by 0 days.

(21) Appl. No.: 17/746,579

(22) Filed: May 17, 2022

(65) Prior Publication Data

US 2022/0371781 A1 Nov. 24, 2022

Related U.S. Application Data

(60) Provisional application No. 63/190,082, filed on May 18, 2021.

(51) Int. Cl.
*B65D 25/10* (2006.01)

(52) U.S. Cl.
CPC ..... *B65D 25/108* (2013.01)

(58) Field of Classification Search
CPC ..... B65D 25/108; B65D 43/12; B65D 7/10; B65D 11/12; B65D 71/70; B65D 85/20;
(Continued)

(56) References Cited

U.S. PATENT DOCUMENTS 2,702,647 A 2/1955 Wesling
4,105,407 A 8/1978 Sanderson
(Continued)

FOREIGN PATENT DOCUMENTS

CN 1726148 1/2006
CN 101237896 8/2008
(Continued)

OTHER PUBLICATIONS

Extended European Search Report in European Appln No. 22174019.4, dated Oct. 20, 2022, 8 pages.
(Continued)

*Primary Examiner* — Robert Poon
(74) *Attorney, Agent, or Firm* — Fish & Richardson P.C.

(57) ABSTRACT

A transport assembly with an upper part including a plurality of sleeves, each sleeve extending along a sleeve axis between a top opening and a bottom opening, wherein the plurality of sleeves are arranged with their respective axes in parallel to one another, and a lower part including a plate with a plurality of apertures that each extend through the plate. The upper part and the lower part can be coupled such that each bottom opening is arranged adjacent to one of the plurality of apertures, and the upper part and the lower part can be moved relative to one another between a closed configuration in which a perimeter of each bottom opening intersects a perimeter of a corresponding aperture at two or more points, and an open configuration in which the perimeter of each bottom opening is aligned with or is enclosed by the perimeter of a corresponding aperture.

14 Claims, 19 Drawing Sheets

(58) Field of Classification Search
CPC ... A61M 5/008; A61J 1/16; B01L 9/54; B01L 9/00
USPC ..... 220/507, 527, 625; 206/761, 765, 733, 206/763, 199, 426, 443
See application file for complete search history.

(56) References Cited

U.S. PATENT DOCUMENTS

| | | | | |
|---|---|---|---|---|
| 4,126,224 | A * | 11/1978 | Laauwe | B65D 43/20 220/345.2 |
| 4,174,034 | A | 11/1979 | Hoo | |
| 4,457,432 | A | 7/1984 | Solheim | |
| 4,561,544 | A * | 12/1985 | Reeve | B65D 50/045 220/345.3 |
| 4,722,440 | A | 2/1988 | Johnston | |
| 5,080,222 | A * | 1/1992 | McNary | B65D 43/12 220/345.3 |
| 5,275,291 | A | 1/1994 | Sledge | |
| 5,372,787 | A | 12/1994 | Ritter | |
| 7,300,637 | B2 | 11/2007 | Lin et al. | |
| 7,708,142 | B2 | 5/2010 | Ehrlund | |
| 8,679,404 | B2 | 3/2014 | Liburd et al. | |
| 9,918,898 | B2 | 3/2018 | Fadeev et al. | |
| 9,938,042 | B1 | 4/2018 | Aryanpanah et al. | |
| 10,017,294 | B2 | 7/2018 | Deutschle et al. | |
| 10,703,539 | B2 | 7/2020 | Deutschle et al. | |
| 12,006,125 | B2 | 6/2024 | Hutterer et al. | |
| 2002/0022246 | A1 | 2/2002 | Lin et al. | |
| 2003/0091471 | A1 | 5/2003 | Lacabanne | |
| 2003/0183547 | A1 | 10/2003 | Heyman | |
| 2003/0199082 | A1 | 10/2003 | Miller et al. | |
| 2006/0086638 | A1 | 4/2006 | Priebe et al. | |
| 2007/0181458 | A1 | 8/2007 | Ehlund | |
| 2007/0196632 | A1 | 8/2007 | Meyer, Jr. et al. | |
| 2008/0236631 | A1 | 10/2008 | Lin et al. | |
| 2008/0317912 | A1 | 12/2008 | Keller et al. | |
| 2009/0158912 | A1 | 6/2009 | Nesbitt | |
| 2011/0086141 | A1 | 4/2011 | Strilich et al. | |
| 2011/0094901 | A1 | 4/2011 | Ingvardsen et al. | |
| 2011/0296800 | A1* | 12/2011 | Clark | B65D 5/503 53/443 |
| 2012/0211492 | A1 | 8/2012 | Kelly | |
| 2013/0169132 | A1 | 7/2013 | Johnson et al. | |
| 2013/0280134 | A1 | 10/2013 | Hoffman et al. | |
| 2014/0027326 | A1 | 1/2014 | Peruzzo | |
| 2014/0216059 | A1 | 8/2014 | Moore et al. | |
| 2015/0108034 | A1 | 4/2015 | Deutschle et al. | |
| 2015/0175304 | A1 | 6/2015 | Ficker | |
| 2016/0288126 | A1 | 10/2016 | Motadel et al. | |
| 2017/0073091 | A1 | 3/2017 | Deutschle et al. | |
| 2017/0225162 | A1 | 8/2017 | Liu et al. | |
| 2017/0247132 | A1 | 8/2017 | Deutschle et al. | |
| 2017/0333938 | A1 | 11/2017 | Brennan et al. | |
| 2018/0057249 | A1 | 3/2018 | Bertolin | |
| 2018/0116907 | A1 | 5/2018 | Fadeev et al. | |
| 2018/0208377 | A1 | 7/2018 | Kloke et al. | |
| 2019/0083697 | A1* | 3/2019 | Evans | B32B 27/32 |
| 2019/0299217 | A1 | 10/2019 | Motadel et al. | |
| 2019/0343721 | A1 | 11/2019 | Komann et al. | |
| 2020/0246223 | A1* | 8/2020 | Nicolas | B65D 25/108 |
| 2022/0371760 | A1 | 11/2022 | Redeker et al. | |
| 2022/0371762 | A1 | 11/2022 | Rosenman et al. | |
| 2022/0371765 | A1 | 11/2022 | Hutterer et al. | |
| 2022/0371773 | A1 | 11/2022 | Hutterer et al. | |
| 2022/0371807 | A1 | 11/2022 | Hutterer et al. | |
| 2024/0286816 | A1 | 8/2024 | Hutterer et al. | |

FOREIGN PATENT DOCUMENTS

| | | | |
|---|---|---|---|
| CN | 101272811 | | 9/2008 |
| CN | 101336194 | | 12/2008 |
| CN | 104271346 | | 1/2015 |
| CN | 104755604 | | 7/2015 |
| CN | 106347771 | | 1/2017 |
| CN | 106458416 | | 2/2017 |
| CN | 106998715 | | 8/2017 |
| CN | 207045959 | U | 2/2018 |
| CN | 108473247 | | 8/2018 |
| CN | 110481984 | A | 11/2019 |
| CN | 210285018 | U | 4/2020 |
| CN | 111655590 | A | 9/2020 |
| DE | 2952733 | | 7/1981 |
| DE | 9112325 | | 11/1991 |
| DE | 202012010704 | | 12/2012 |
| DE | 102013114404 | A1 | 6/2015 |
| DE | 102020206748 | | 12/2020 |
| EP | 0780315 | | 6/1997 |
| EP | 0903176 | | 3/1999 |
| EP | 1780143 | | 5/2007 |
| EP | 2408483 | | 1/2012 |
| EP | 2543391 | | 3/2016 |
| EP | 3345587 | | 7/2018 |
| FR | 1277678 | | 12/1961 |
| FR | 1439210 | | 5/1966 |
| JP | 2001112857 | | 4/2001 |
| JP | 2016196306 | A | 11/2016 |
| KR | 20120006140 | | 9/2012 |
| WO | WO 2010/106168 | | 9/2010 |
| WO | WO 2011/135085 | | 11/2011 |
| WO | WO 2014/130349 | | 8/2014 |
| WO | WO 2015/076780 | | 5/2015 |
| WO | WO 2017/044906 | | 3/2017 |
| WO | WO 2018/175985 | | 9/2018 |
| WO | WO 2021050450 | | 3/2021 |

OTHER PUBLICATIONS

Extended European Search Report in European Appln No. 22174021.0, dated Oct. 25, 2022, 9 pages.

Extended European Search Report in European Appln. No. 22174016.0, dated Oct. 17, 2022, 9 pages.

Extended European Search Report in European Appln. No. 22174017.8, dated Nov. 2, 2022, 6 pages.

Extended European Search Report in European Appln. No. 22174018.6 dated Nov. 10, 2022, 6 pages.

Atkins, Nick, "Sterile Ready-to-Fill Components | Adelphi Healthcare Packaging", Nov. 28, 2012, pp. 1-1, Retrieved from the Internet: URL: https://adelphi-hp.com/news-events/sterile-ready-to-fill%C2%AE-components [retrieved on Sep. 23, 2022].

Lavajo Nathalie et al: "Specifications—Vials and bottles for parenteral application Code: PC-00132 Revision : 08 Specifications Vials and bottles for parenteral application: Injectables Infusions Approval cycle", Oct. 16, 2019, pp. 1-25, Retrieved from the Internet: URL:https://www.sgd-pharma.com/sites/default/files/mediacenter/pc-00132_08_-_specifications_-_parenteral_application_vials_and_bottles_0.pdf [retrieved on Mar. 24, 2023].

Le Printing Machine Factory Limited: "How to Manufacture Glass Bottles", Sep. 10, 2016, Retrieved from the Internet: URL:https://www.youtube.com/watch?v=hGjYRaYjryI [retrieved on Mar. 24, 2023].

Manufacturing Chemist Redactor: "Pure, smooth and strong", Apr. 16, 2021, pp. 1-10, Retrieved from the Internet: URL:https://www.manufacturingchemist.com/news/article_page/Pure_smooth_and_strong/175981 [retrieved on Mar. 24, 2023].

Schott: "EVERIC smooth", Jan. 17, 2020, Retrieved from the Internet: URL:https://www.youtube.com/watch?v=niHtVIYbQaM [retrieved on Jun. 30, 2023].

Wang, "Science of Packaging Materials," China Light Industry Press, Feb. 28, 2017, pp. 188-189.

Xiao et al., "Roll-forming process and CAE analysis of drawer idler slide rail," Forging & Stamping Technology, 2010, 35(2):31-34 (Abstract only).

Office Action in Chinese Appln. No. 202210538011.X, mailed Oct. 30, 2024, 17 pages (with English Translation).

Kegao et al., "Craftsman design of shipping packaging size (I)," Shanghai Packaging, Jun. 28, 2016, 6:13-15 (Abstract Only).

(56) References Cited

OTHER PUBLICATIONS

Office Action in Chinese Appln. No. 202210538011.X, mailed Feb. 26, 2025, 12 pages (with English translation).

* cited by examiner

TRANSPORTING PACKAGING UNITS

CROSS-REFERENCE TO RELATED APPLICATION

This application claims the benefit of priority to U.S. Provisional Patent Application No. 63/190,082, filed on May 18, 2021, the entire contents of which are incorporated by reference herein.

BACKGROUND

This disclosure relates to an assembly and method for transporting packaging units.

In industrial contexts, products are generally transported and sold in packaging units. Packaging units can include vials, cartridges, ampoules, bottles, or pre-fillable syringes. In many industries, these different types of packaging units are collectively known as "primary packaging," i.e., the packaging that comes into direct contact with an end product. The end product may be a food product, a cosmetic product, or a pharmaceutical product. Primary packaging can undergo numerous manufacturing processes before being filled with the end product. During these processes, primary packaging is often processed in batches.

SUMMARY

Aspects of the present disclosure aim to provide an assembly and method for transporting packaging units between various industrial processes.

According to a first general aspect of the present disclosure, a transport assembly includes an upper part that comprises a plurality of sleeves, each sleeve extending along a sleeve axis between a top opening and a bottom opening, wherein the plurality of sleeves are arranged with their respective axes in parallel to one another, and a lower part that comprises a plate with a plurality of apertures that each extend through the plate. The upper part and the lower part can be coupled such that each bottom opening is arranged adjacent to one of the plurality of apertures, and the upper part and the lower part can be moved relative to one another between a closed configuration in which a perimeter of each bottom opening intersects a perimeter of a corresponding aperture at two or more points, and an open configuration in which the perimeter of each bottom opening is aligned with or is enclosed by the perimeter of a corresponding aperture. In other words, a center of each aperture coincides with the sleeve axis and an axis of the packaging unit disposed in the sleeve, respectively. In the context of this disclosure, "aligned with" can also mean superimposed or matched.

The bottom openings and the apertures may have the same shape and, in some instances, have the same size. It is also possible for the apertures to be larger than the bottom openings.

The upper part can include one or more upper guide surfaces and the lower part can include one or more lower guide surfaces. Each upper guide surface can be configured for sliding engagement with a corresponding lower guide surface as the upper part and lower part move between the closed configuration and the open configuration. One of the one or more upper guide surfaces and lower guide surfaces can extend along an outer edge of the transport assembly, for example. The plurality of sleeves and apertures can be arranged in one or more respective rows, and one of the one or more upper guide surfaces and lower guide surfaces extend between two adjacent rows of corresponding sleeves and apertures.

The lower part can include a pair of projections arranged on opposite sides of the lower part and configured to abut a respective one of the plurality of sleeves.

An outer edge of the upper part can include a recessed portion, and an outer edge of the lower part can include a tab. The recessed portion and the tab can be gripped to move the upper part and lower part between the closed configuration and the open configuration.

The transport assembly can include a lock that engages when the upper part and lower part are in the closed configuration to prevent relative movement between the upper part and the lower part.

The upper part can include a flange arranged adjacent to the top openings of the plurality of sleeves.

According to a second general aspect of the present disclosure, a method includes receiving an upper part that comprises a plurality of sleeves, each sleeve extending along a sleeve axis between a top opening and a bottom opening, wherein the plurality of sleeves are arranged with their respective axes in parallel to one another; receiving a lower part that comprises a plate with a plurality of apertures that each extend through the plate; coupling the upper part to the lower part such that each bottom opening is arranged adjacent to one of the plurality of apertures; moving the upper part and the lower part into a closed configuration in which a perimeter of each bottom opening intersects a perimeter of a corresponding aperture at two or more points; and loading a plurality of packaging units in respective sleeves of the upper part, wherein an opening of each container is arranged adjacent to the top opening of the sleeve, and a bottom of each container is arranged adjacent to the bottom opening of the sleeve and supported from below by the lower part.

The method can include moving the upper part and the lower part into an open configuration in which the perimeter of each bottom opening is aligned with or is enclosed by the perimeter of a corresponding aperture, and moving the bottom of each container through a respective bottom opening and aperture to rest the container on a flat surface.

The method can include returning the upper part and the lower part into the closed configuration, such that the lower part is positioned between the bottom of each container and the flat surface.

The method can include locking the upper part and the lower part in the closed configuration to prevent relative movement between the upper part and the lower part.

These and other embodiments described herein may provide one or more of the following benefits. The transport assembly and method according to the present disclosure can be used to transport a plurality of packaging units at once. For example, the upper part can secure and separate the individual packaging units from one another. In the open position, the packaging units can be released from the transport assembly simultaneously. In some instances, the transport assembly can be removed to allow further processing of the packaging units. Simultaneous release may replace individual unloading of the packaging units by hand or by machine. The released packaging units may also remain within the transport assembly in the open configuration, e.g., to facilitate thermal transfer between the bottoms of the packaging units and a lyophilization table or plate. After the lyophilization process is completed, the transport assembly may be returned to the closed configuration to simultaneously retrieve the packaging units for further transport.

DESCRIPTION OF THE DRAWINGS

Certain embodiments will now be described, by way of example only, with reference to the accompanying drawings, in which.

Like reference numbers and designations in the various drawings indicate like elements.

DETAILED DESCRIPTION

Figure 1:
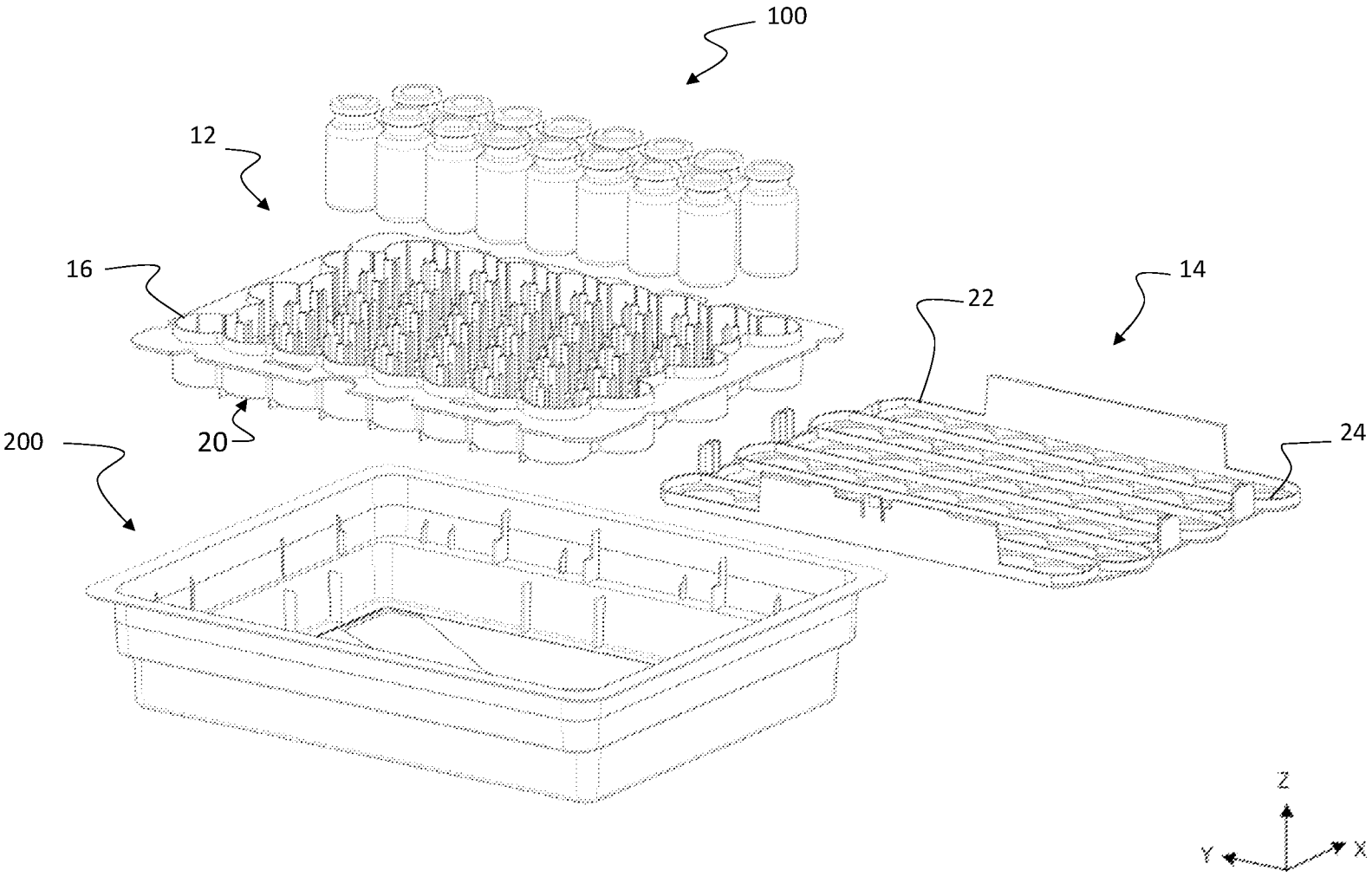
FIG. 1 shows the components of a first transport assembly according to the present disclosure, a plurality of vials, and a transport container.

FIG. 1 shows the components of a transport assembly 10 according to the present disclosure, a plurality of packaging units 100, and a transport container 200. The packaging units 100 can serve as primary packaging for various types of end products. Although the expression "primary packaging" can encompass vials, cartridges, ampoules, bottles, and syringes to name a few examples, the following description will refer to "vials" for all types of primary packaging. The container 200 can serve as "secondary packaging," i.e., packaging that groups, protects, and labels the primary packaging.

Figure 8:
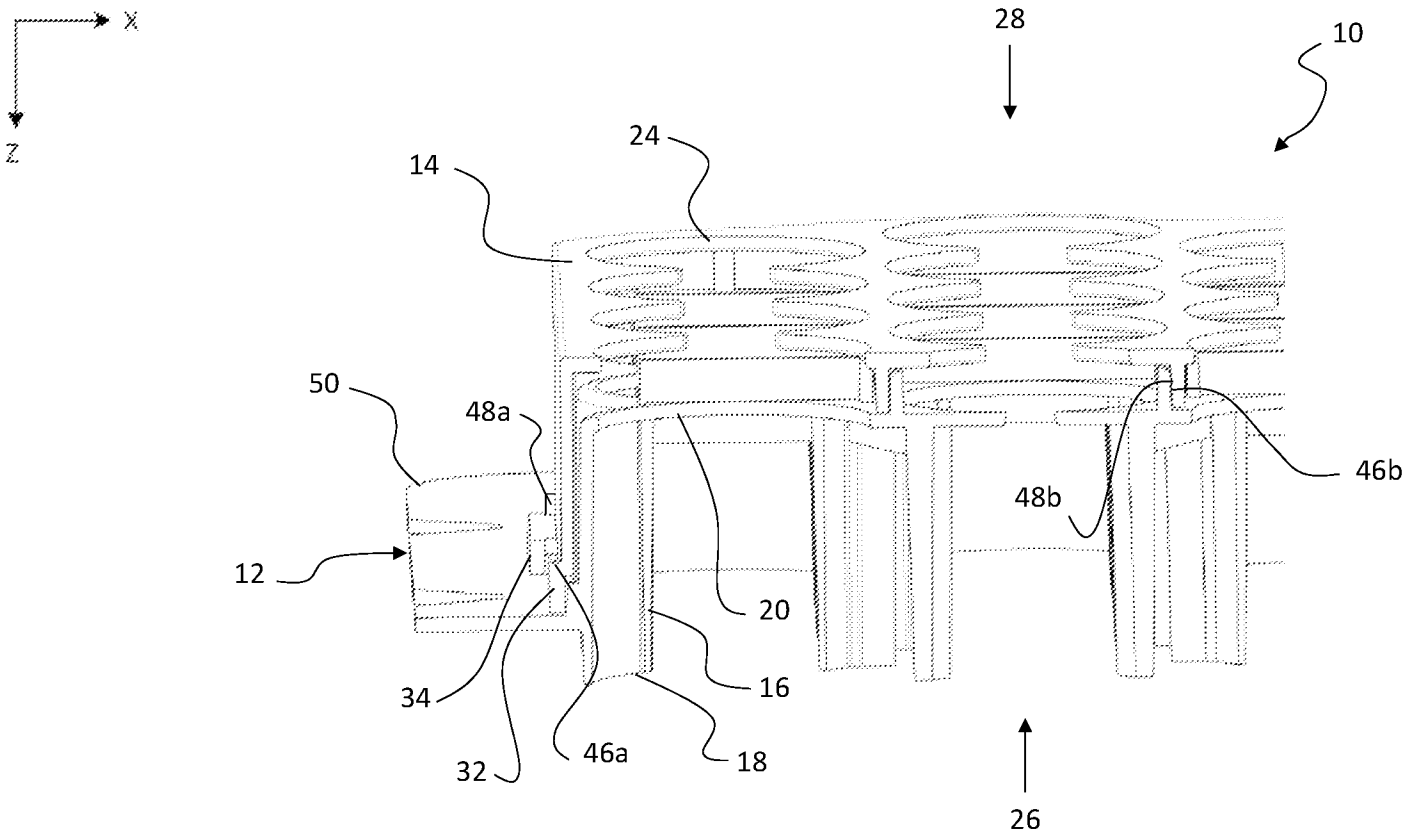
FIG. 8 shows a partial cross-sectional view of the transport assembly of FIGS. 1 to 6.

The transport assembly 10 can be used to securely position the vials 100 within the container 200 and includes an upper part 12 and a lower part 14 that are configured to couple to one another. The upper part 12 includes a plurality of sleeves 16. Each sleeve extends along a sleeve axis between a top opening 18 and a bottom opening 20 (FIG. 8). Referring to the coordinate axes shown in FIG. 1, the plurality of sleeves 16 are arranged with their respective axes extending in parallel along the Z-axis. The lower part 14 includes a plate 22 with a plurality of apertures 24 that each extend through the plate 22 in the direction of the Z-axis. The upper part 12 and the lower part 14 can be coupled such that each bottom opening 20 is arranged adjacent to one of the plurality of apertures 24 in the lower part 14.

Figure 2:
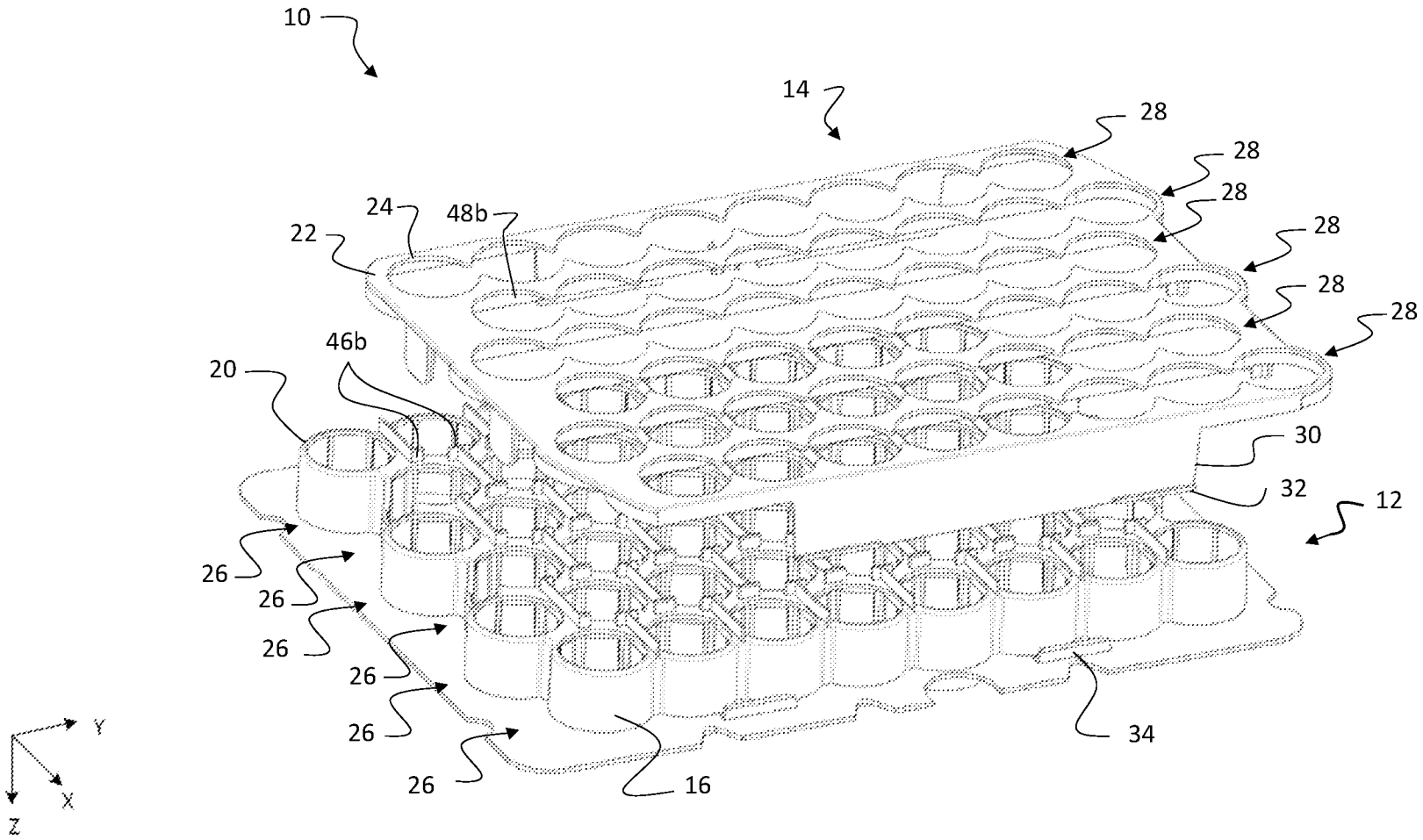
FIGS. 2 to 4 show the parts of the transport assembly of FIG. 1 from below.

FIG. 2 shows the upper part 12 and the lower part 14 from below. As illustrated, the upper part 12 includes an array of sleeves 16 formed by six rows 26 of eight sleeves 16 each. The lower part 14 includes an array of apertures 24 formed by six rows 28 of eight apertures 24 each. Although the number of sleeves 16 and apertures 24 may vary from what is shown, the respective arrays will generally have the same dimensions and arrangement.

Figure 3:
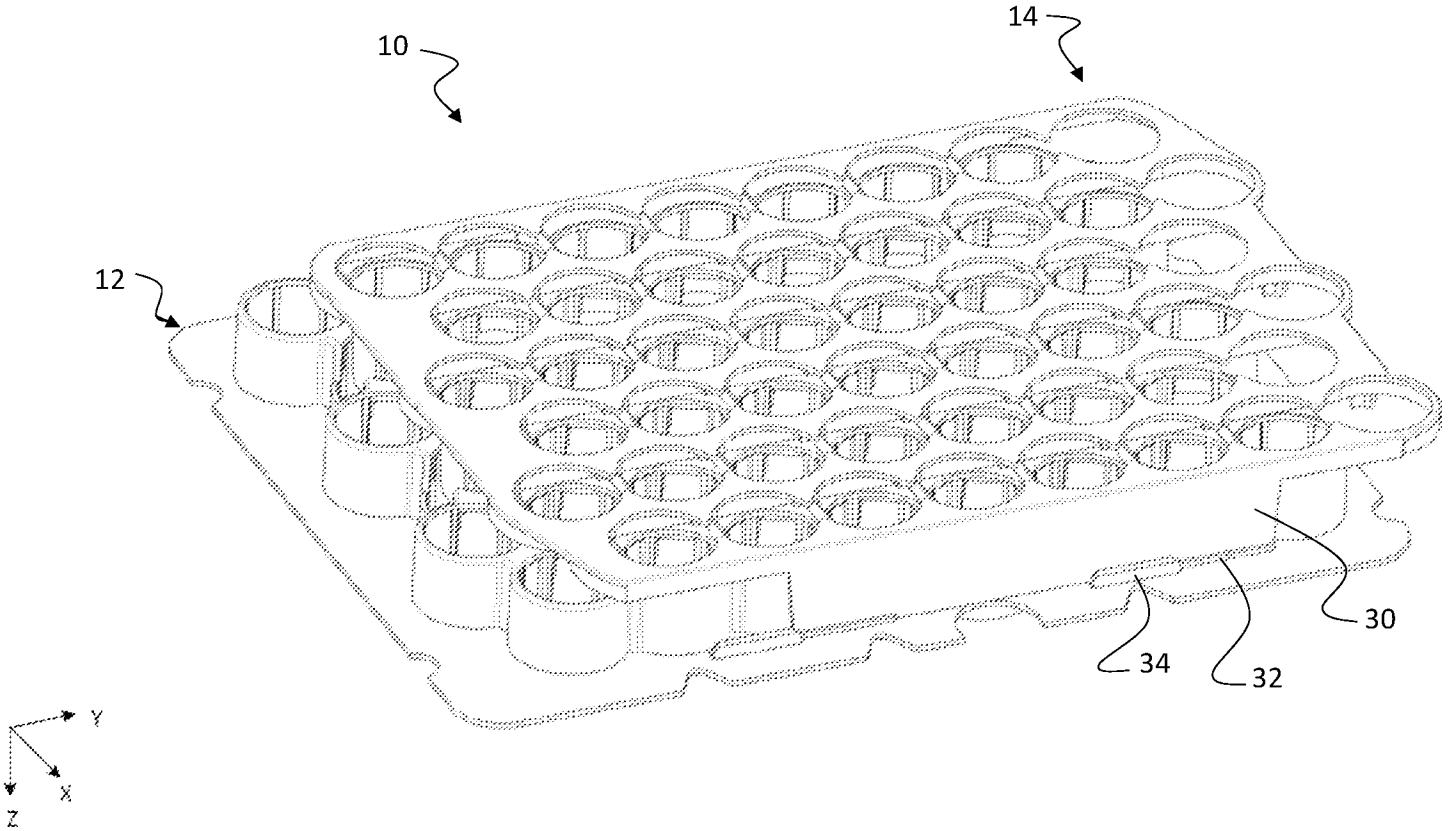

The upper part 12 and the lower part 14 can be coupled to one another. For example, FIG. 2 shows the lower part as having two tabs 30 that extend along the Z-axis, towards the upper part 12. The end of each tab 30 is provided with two hooks 32 that are designed to engage corresponding hooks 34 formed on the upper part 12. FIG. 3 shows the hooks 32, 34 arranged adjacent to one another without overlapping. In the position shown in FIG. 3, the hooks 32, 34 are not engaged, and the upper and lower parts 12, 14 can still be separated from one another.

Figure 4:
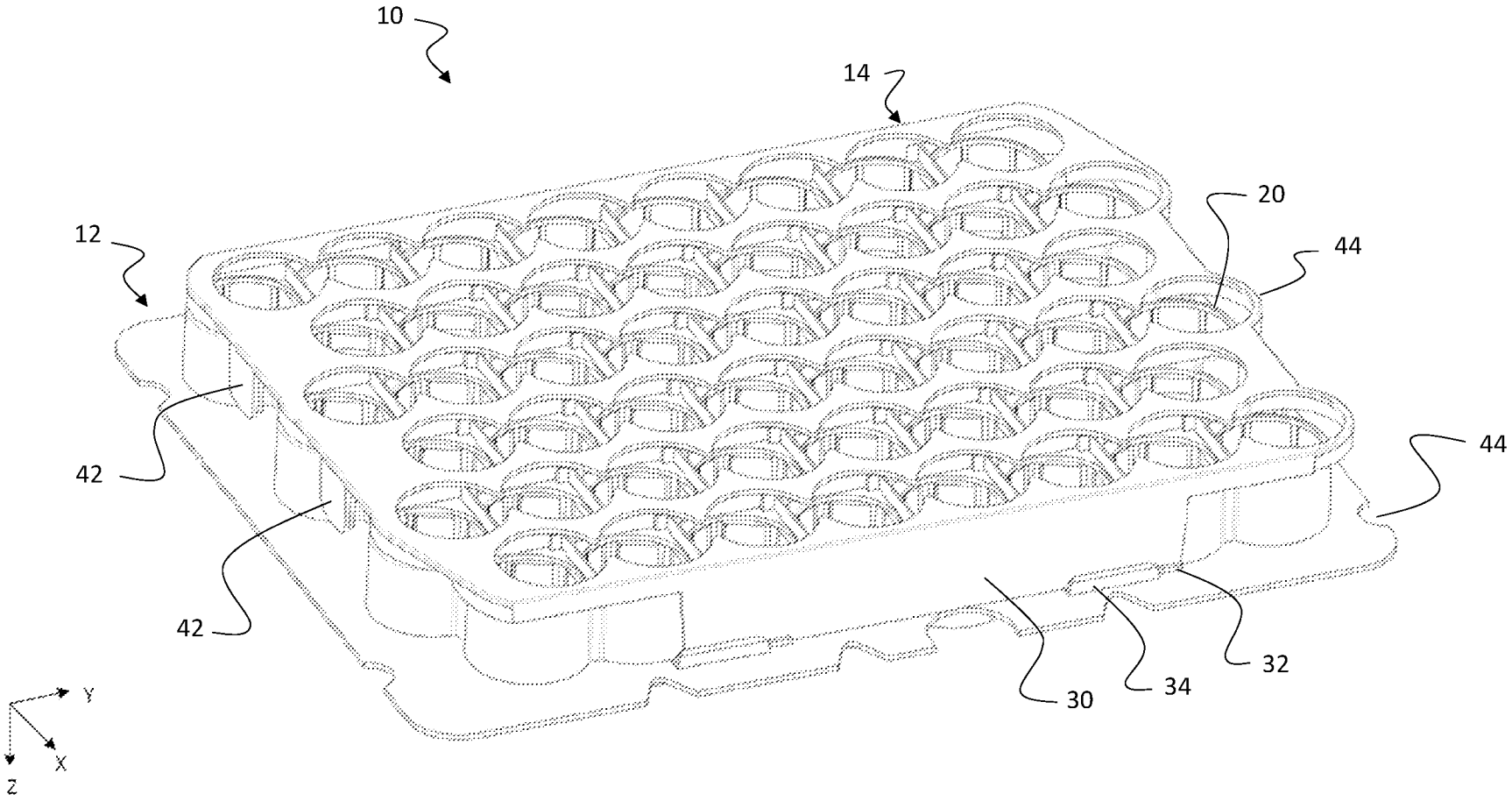

FIG. 4 shows the upper part 12 and the lower part 14 after they have been translated along the Y-axis to bring the hooks 32, 34 into engagement. In other words, the upper part 12 and the lower part 14 are coupled. In the coupled position, each bottom opening 20 is arranged adjacent to one of the plurality of apertures 24. From the coupled position shown in FIG. 4, the upper part 12 and the lower part 14 can be moved along the Y-axis relative to one another between a closed configuration shown in FIGS. 5A and 5B and an open configuration shown in FIGS. 6A and 6B.

An outer edge of the upper part 12 can include one or more recessed portions 44, and an outer edge of the lower part 14 can include one or more tabs 42. The recessed portions 44 and tabs 42 can be gripped on opposite sides of the transport assembly 10 to move the upper part 12 and lower part 14 between the closed configuration and the open configuration.

Figure 5A:
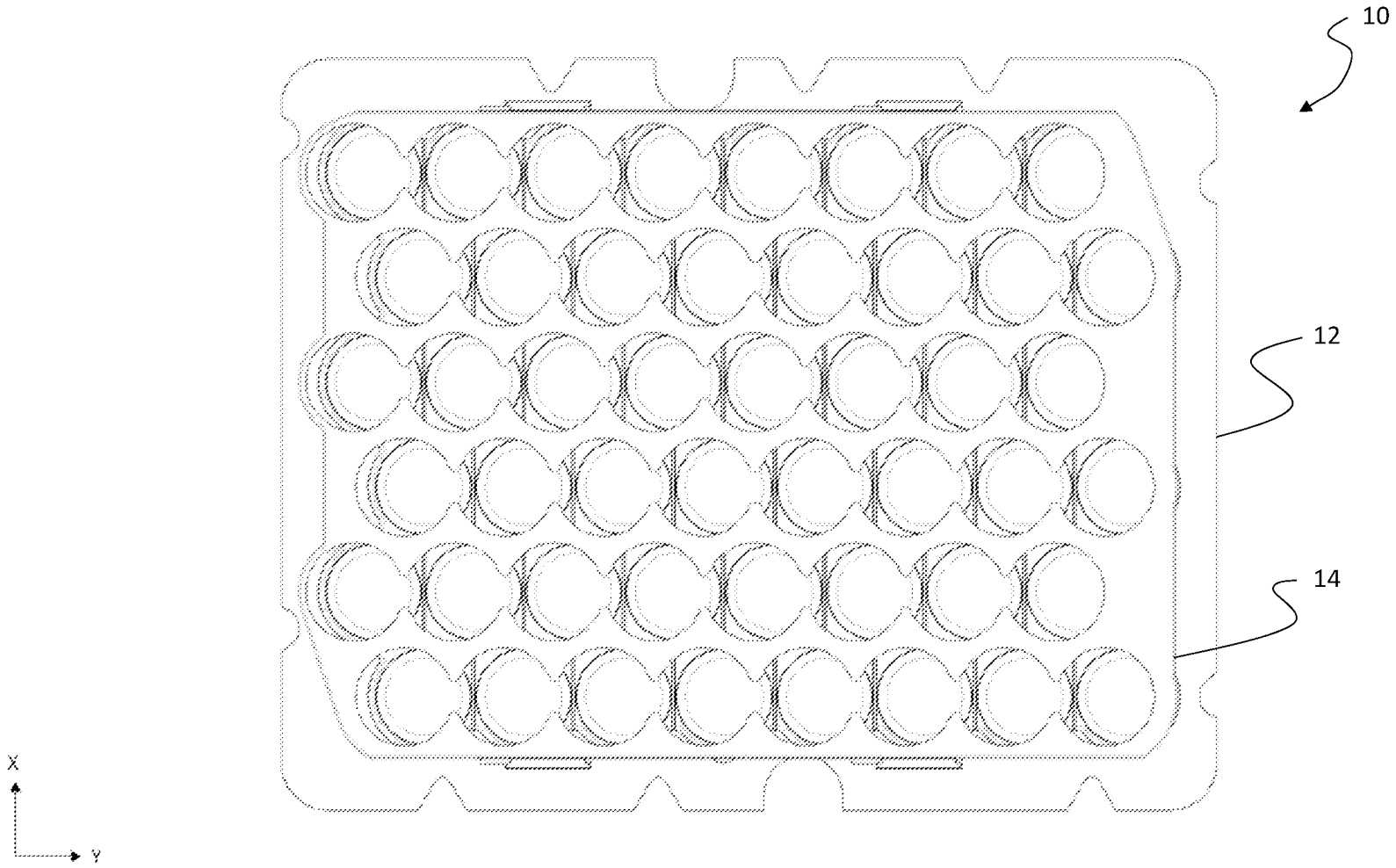
FIGS. 5A, 5B, 6A and 6B show the parts of FIG. 1 in a closed and open configuration, respectively.
Figure 5B:
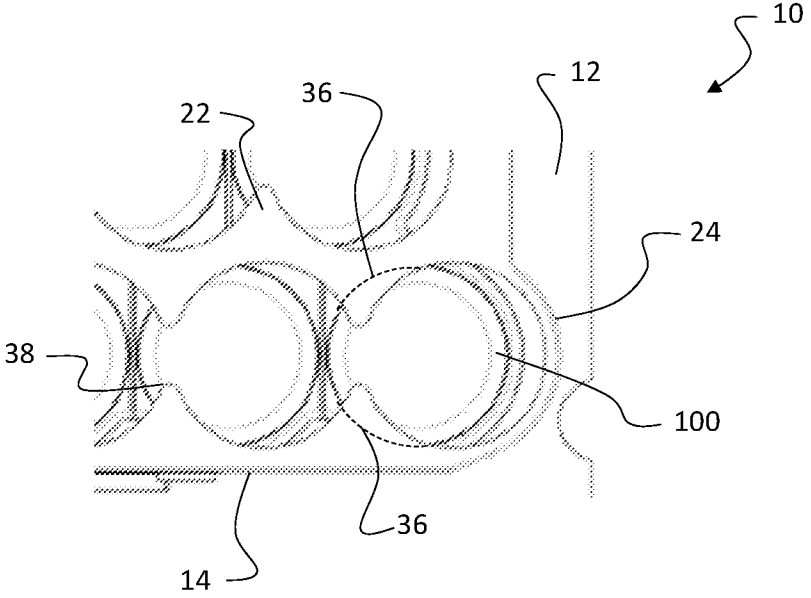
Figure 9:
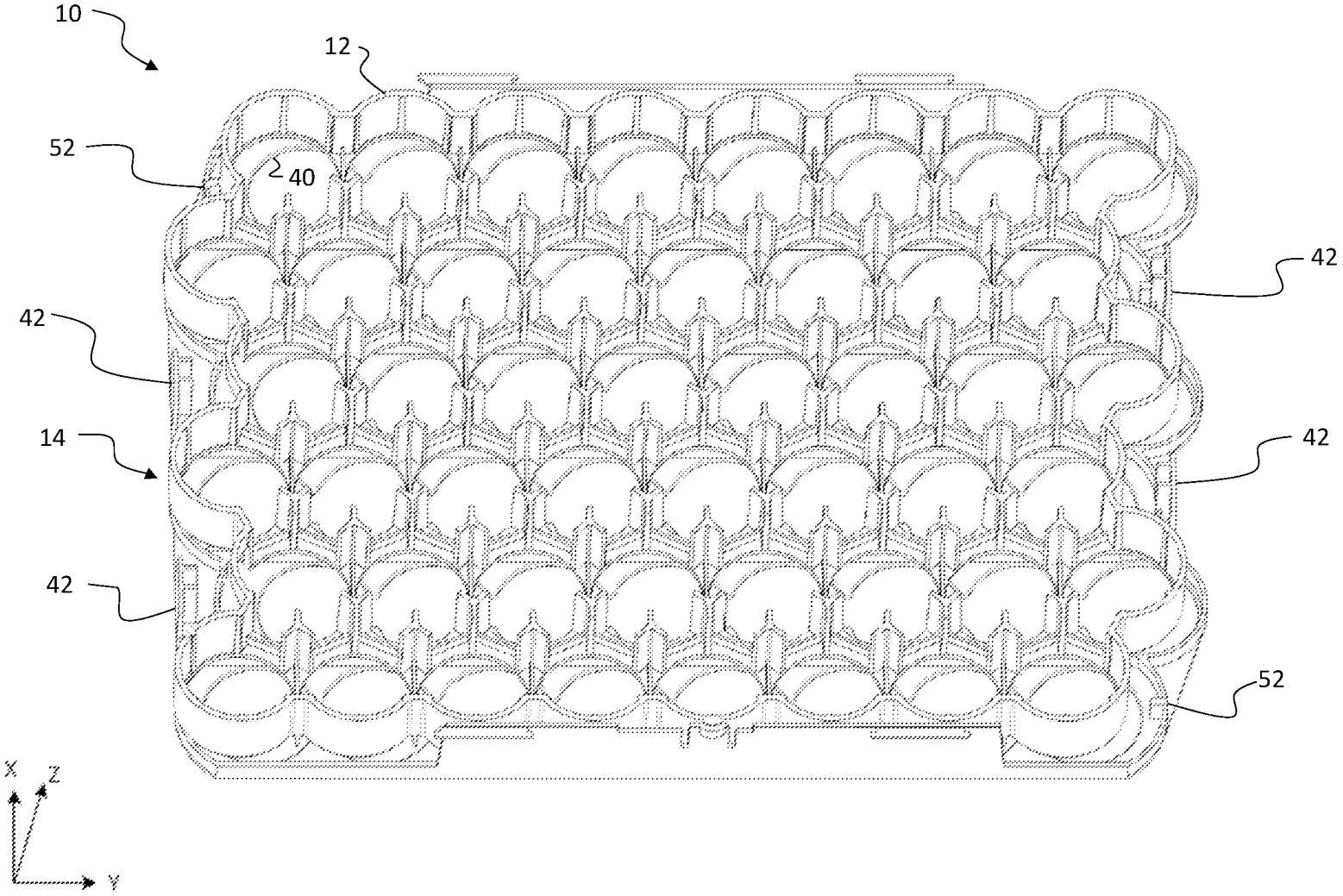
FIG. 9 shows a cross-sectional view of the transport assembly of FIGS. 1 to 6 and 8 in the closed configuration.

FIG. 5A shows the upper part 12 and the lower part 14 from below in the closed configuration. FIG. 5B is an enlarged partial view of FIG. 5B. In the closed configuration, a perimeter of each bottom opening 20 intersects a corresponding aperture 24 at two or more points. In FIG. 5B, the bottom openings 20 and the apertures 24 are arranged so closely that the perimeter of the bottom opening 20 intersects the aperture 24 at four points in total, as shown by the dashed lines 36. Due to the intersection, the sections of the plate inward of the dashed lines 36 overlap with the bottom opening 20. The overlapping portions support a bottom of the vial 100 (FIG. 9). In FIGS. 1 to 5, the apertures 24 are formed with one or more gaps 38. In some instances, the apertures 24 may not include gaps 38, and each bottom opening 20 may be overlapped by a single, continuous portion 40 of the plate 22 (FIG. 7A to 7D).

Figure 6A:
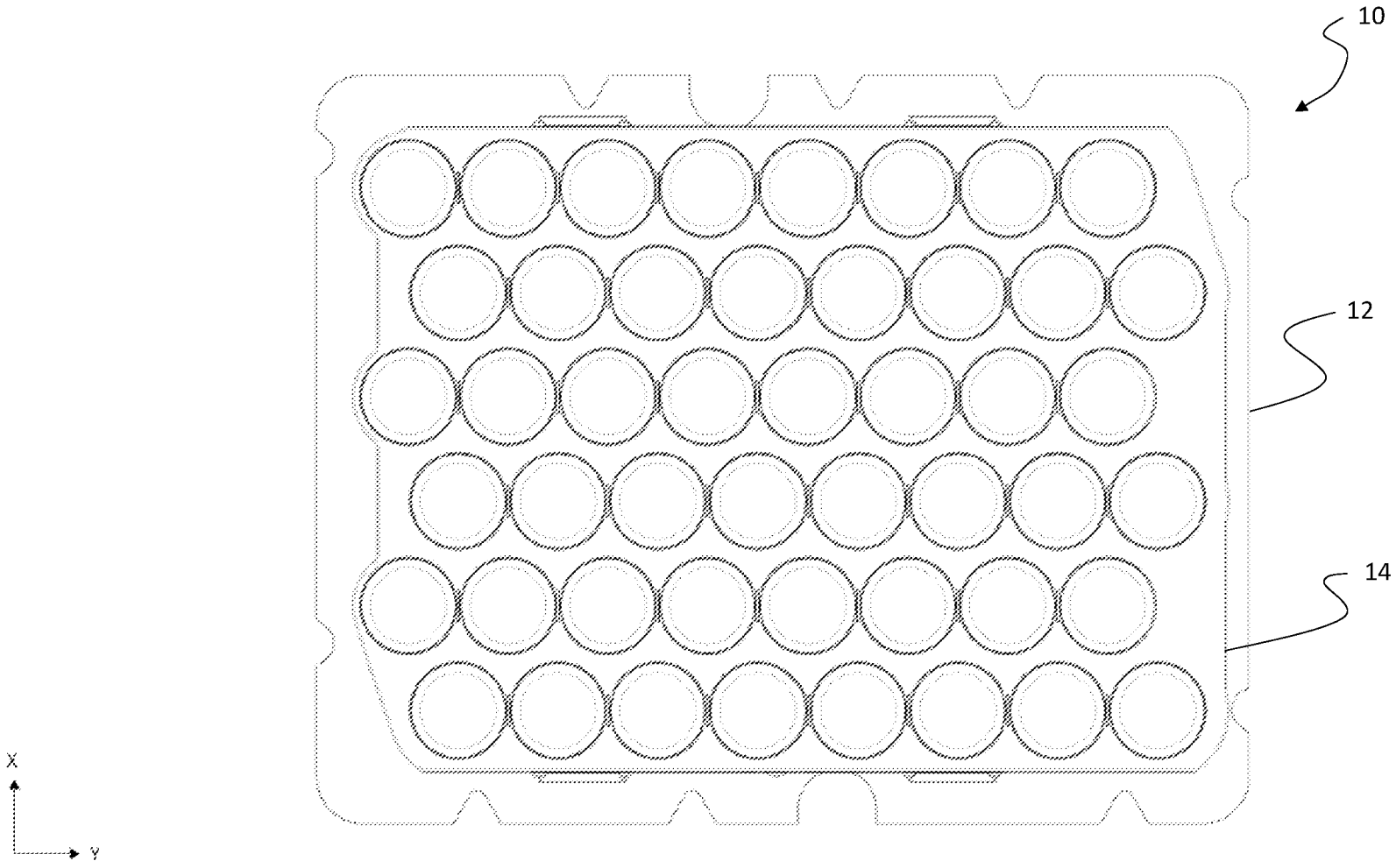
Figure 6B:
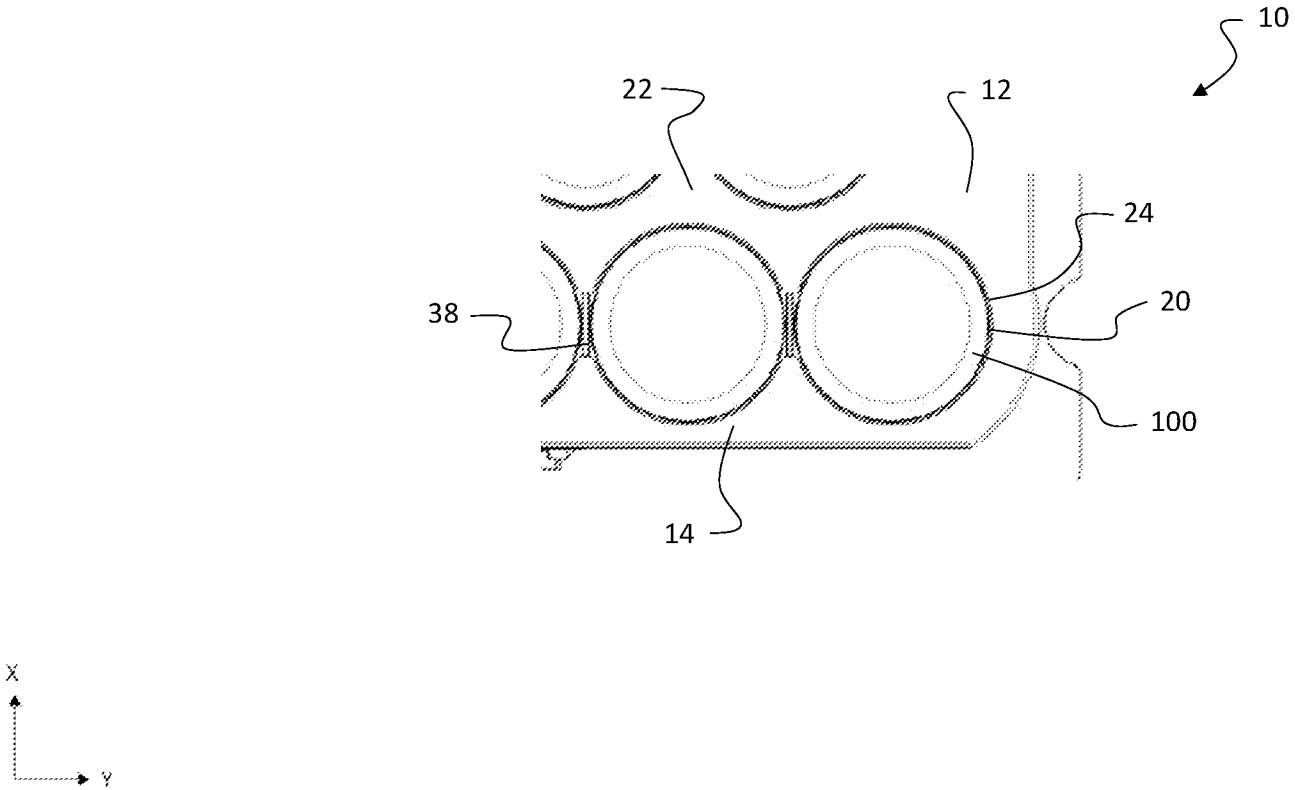

From the closed configuration shown in FIGS. 5A and 5B, the lower part 14 can be shifted to the left along the Y-axis and into the open configuration shown in FIGS. 6A and 6B. In the open configuration, the perimeter of each bottom opening 20 is aligned with or is enclosed by the perimeter of a corresponding aperture 24. In other words, a center of each aperture 24 coincides with the sleeve axis and an axis of the vial 100, respectively. The alignment eliminates the overlapping sections that support the bottom of the vial 100. Thus, the vial 100 is free to pass through both the bottom opening 20 and the aperture 24. In FIGS. 6A and 6B, the bottom openings 20 and the apertures 24 have substantially the same shape and size. In the context of this disclosure, "aligned with" can also mean superimposed or matched.

Figure 7A:
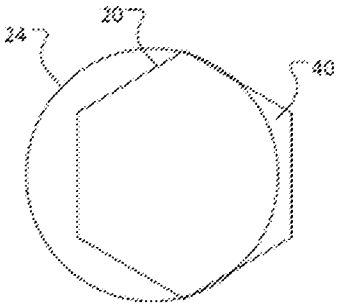
FIGS. 7A-D show various configurations of bottom openings and apertures.
Figure 7B:
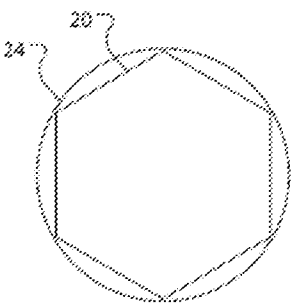
Figure 7C:
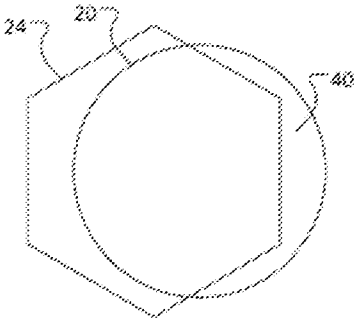
Figure 7D:
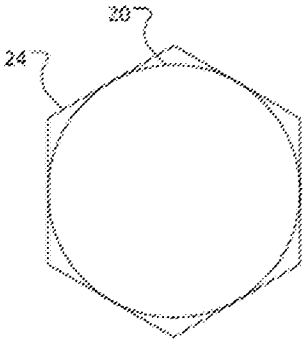

As described above, the apertures 24 are formed with one or more gaps 38. The gaps 38 may make the apertures 24 more flexible and facilitate movement of the vials 100 through the apertures 24. Thus, the apertures 24 can have the same size and shape as the bottom openings 20, which may allow the transport assembly 10 to receive a larger number of vials 100 given the same outer dimensions. In some instances, the apertures 24 may be formed larger than the bottom openings 20 to provide a similar effect. For example, FIGS. 7A and 7B schematically show a circular aperture 24 that is larger than a hexagonal bottom opening 20. In the closed configuration (FIG. 7A), the aperture 24 and the bottom opening 24 intersect to form an overlapping portion 40 that may support the vial 100 arranged in the sleeve 16 connected to the bottom opening 20. In the open configuration (FIG. 7B), the larger aperture 24 completely encloses the bottom opening 20, which allows the vial 100 to move through the bottom opening 20. The same applies to FIGS. 7C and 7D, which show a hexagonal aperture 24 and a circular bottom opening 20.

FIG. 8 is a partial cross-sectional view of the transport assembly 10. To facilitate movement between the open and closed configurations, the upper part 12 can include one or more upper guide surfaces 46 and the lower part can include one or more lower guide surfaces 48. Each upper guide surface 46 is configured for sliding engagement with a corresponding lower guide surface 48 as the upper part 12 and lower part 14 move along the Y-axis, between the closed configuration and the open configuration shown, e.g., in FIGS. 4 to 6.

Figure 11:
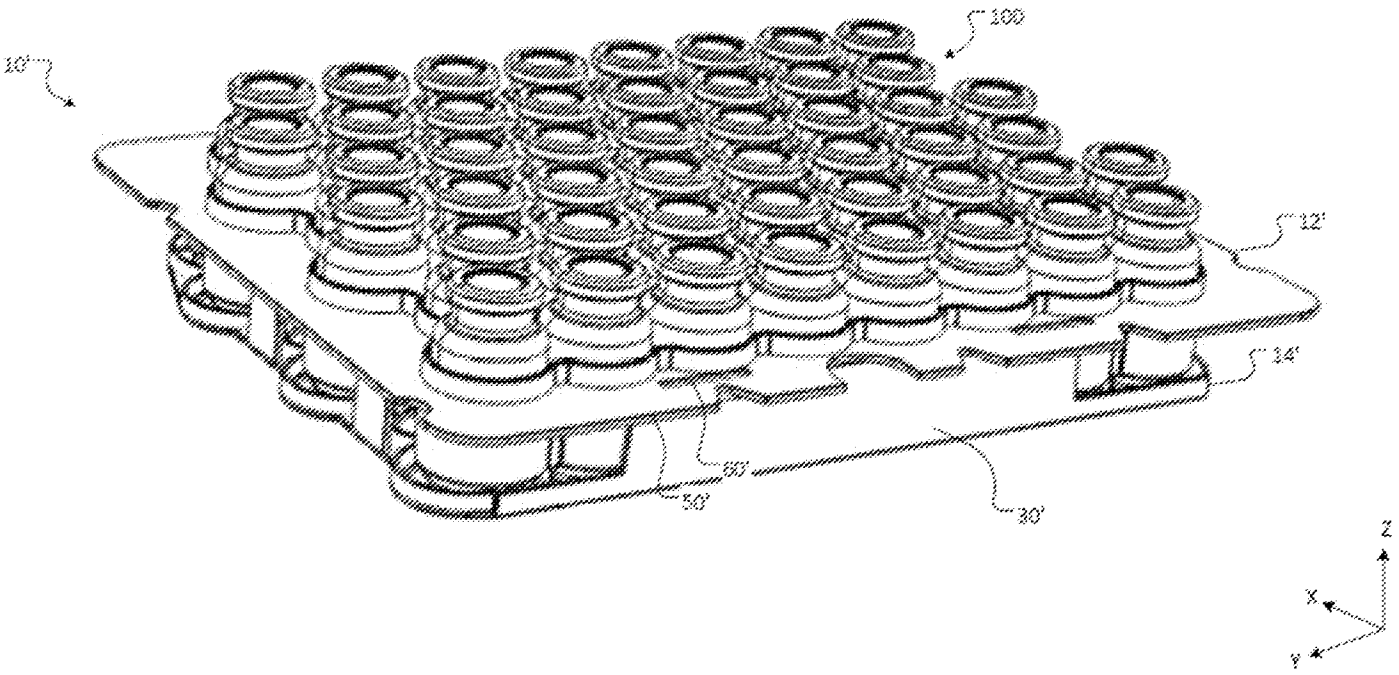
FIG. 11 shows a second transport assembly according to the present disclosure.
Figure 12:
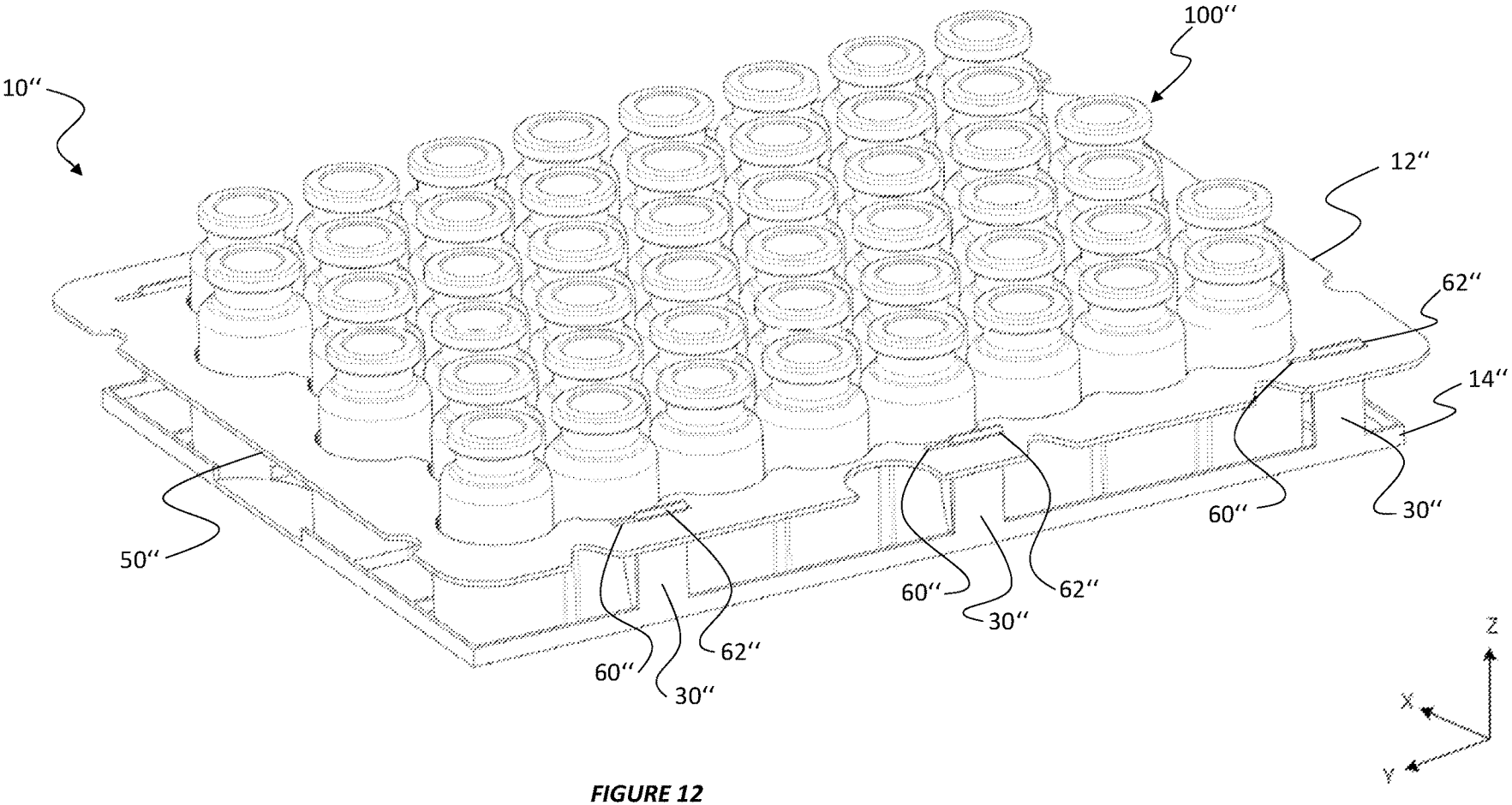
FIGS. 12 and 13 show a third transport assembly according to the present disclosure.

For example, a first upper guide surface 46*a* is designed to slide along a first lower guide surface 48*a*. The first upper and lower guide surfaces 46*a*, 46*b* extend along an outer edge of the transport assembly 10. More specifically, the first upper guide surface 46*a* is formed on an underside of the hook 34, and the first lower guide surface 48*a* is formed on an underside of the hook 32. In other words, the hooks 32, 34 engage to couple the upper part 12 to the lower part 14 and simultaneously provide guide surfaces 46*a*, 48*a* that help the upper and lower parts 12, 14 to transition between the open and closed configurations. As shown in FIGS. 11 and 12, this dual-purpose engagement between the upper and lower parts 12, 14 can have a different design than the one shown in FIG. 8.

In instances in which the sleeves 16 are arranged in one or more sleeve rows 26 and the apertures 24 are arranged in one or more aperture rows 28, the guide surfaces can include a second upper guide surface 46*b* and a second lower guide surface 48*b* that extend between adjacent rows 26, 28 of corresponding sleeves 16 and apertures 24. When such guide surfaces are provided between each of the adjacent rows 26, 28, alignment of the bottom openings 20 and the apertures 24 may be more easily attained in the closed configuration of the transport assembly 10. Referring to the exploded view of FIG. 2, the second lower guide surface 48*b* can be formed on opposite sides of a rib that continuously extends along the Y-axis between two adjacent aperture rows 28. The second upper guide surface 46*b* can be formed by opposing pairs of pads that are designed to contact the respective sides of the rib that forms the second lower guide surface 48*b*.

FIG. 8 also shows the top openings 18 of the plurality of sleeves 16 and a flange 50 of the upper part 12 that is arranged adjacent to the plurality of top openings 18. The flange 50 may be useful for handling the transport assembly 10 and for seating the transport assembly 10 inside the container 200 (FIG. 1).

FIG. 9 is a cross-sectional view of the transport assembly 10 taken in the X-Y plane in the closed configuration. In this view, the overlapping portion 40 between a corresponding bottom opening 20 and aperture 24 is visible. As described, the overlapping portion 40 supports the bottom surface of a vial 100 (not shown), so that the transport assembly 10 can be used to transport the vial 100.

FIG. 9 also shows the tabs 42 for manipulating the lower part 14 in greater detail. As shown, the lower part 14 comprises two sets of tabs 42 on each end of the lower part 14. In some instances, the lower part 14 can include fewer or greater numbers of tabs 42 on each end. In addition to the tabs 42, each end of the lower part 14 includes a projection 52 that is designed to come into contact with the peripheral surface of an adjacent sleeve 16. The projections 52 may ensure proper alignment of the bottom openings 20 and the apertures 24 in the closed configuration of the transport assembly 10 and provide haptic feedback for the user.

Figure 10A:
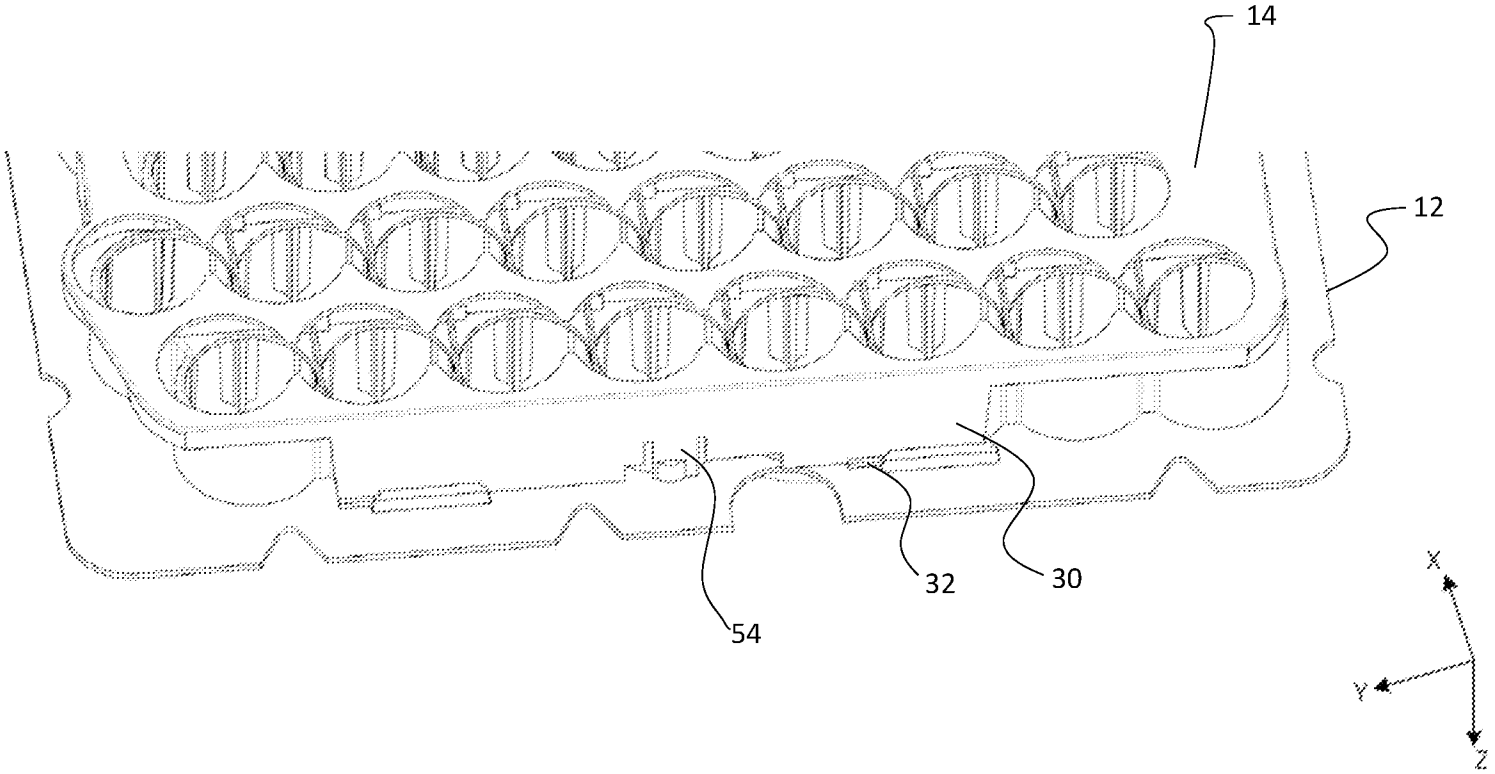
FIGS. 10A and 10B show an optional lock that may lock the transport assembly in the closed configuration.
Figure 10B:
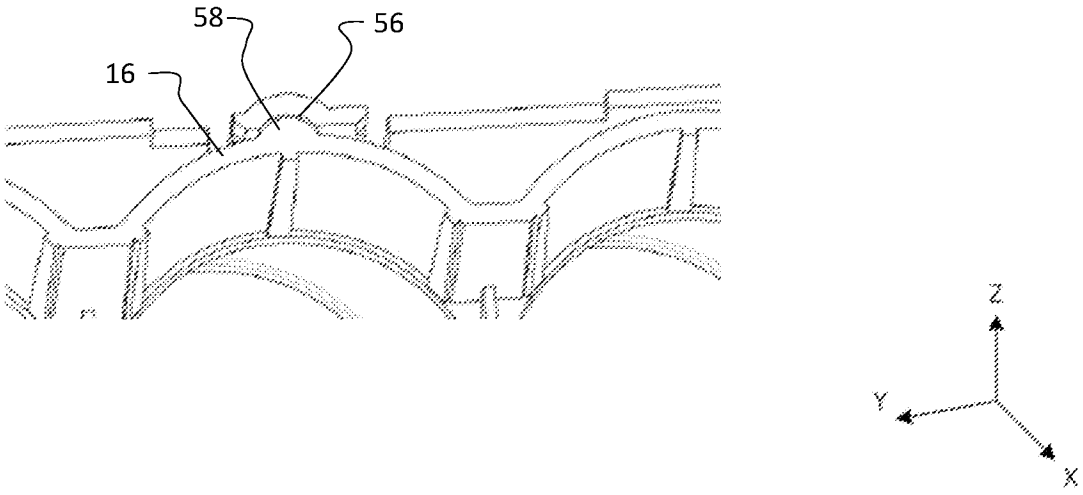

FIGS. 10A and 10B show an optional feature of the transport assembly 10 from below and above, respectively. Specifically, the tab 30 of the lower part 14 that forms the hook 32 is provided with a resilient tongue 54 that is configured to deform as the upper part 12 and the lower part 14 move relative to one another. An inner surface of the resilient tongue 54 is provided with an indentation 56 that is shape matched to a projection 58 formed on an outer peripheral surface of one of the sleeves 16. As the upper part 12 and the lower part 14 are brought into the closed configuration shown in FIG. 10A, the projection 58 snaps into the indentation 56 to lock the transport assembly 10 in the closed configuration. At the same time, the snap-fit engagement between the projection 58 and indentation 56 and the indentation may provide both acoustic and haptic feedback that the transport assembly 10 is in the closed configuration. The illustrated lock may provide additional stability when the transport assembly 10 is used to lift a plurality of vials 100 (not shown). However, the engagement of the lock can be overcome to move the transport assembly 10 into the open configuration to release the vials 100.

Referring now to FIGS. 11 to 14, various modifications of the transport assembly 10 of FIGS. 1 to 10 are shown. The modifications shown in FIGS. 11 to 14 can be combined or replaced with features from the transport assembly of FIGS. 1 to 10 and vice versa.

FIG. 11 shows a plurality of vials 100 seated in a transport assembly 10'. The transport assembly 10' includes an upper part 12' and a lower part 14'. As in FIGS. 1 to 10, the lower part 14' includes a tab 30' that attaches the lower part 14' to the upper part 12'. However, instead of hooks 32, 34, the tab 30' is provided with hooks (not shown) that are designed to engage and translate along slots 60' that are formed in the flange 50' of the upper part 12'. Thus, the slots 60' may provide an upper guide surface that engages a corresponding lower guide surface provided by the hooks on the tab 30'. The hooks and the slot 30' may be easier to assemble than the hooks 32, 34. The slots 60' may be used to limit the relative movement between the upper part 12' and the lower part 14' along the Y-axis.

FIG. 12 shows a plurality of vials 100 seated in a transport assembly 10". The transport assembly 10" includes an upper part 12" and a lower part 14". Instead of the single continuous tab 30, 30' shown in FIGS. 1 to 11, the lower part 14" is attached to the upper part 12" by three shorter tabs 30". The end of each tab 30" comprises a hook 62" that protrudes through a corresponding slot 60" in the upper flange 50" of the upper part 12".

Figure 13:
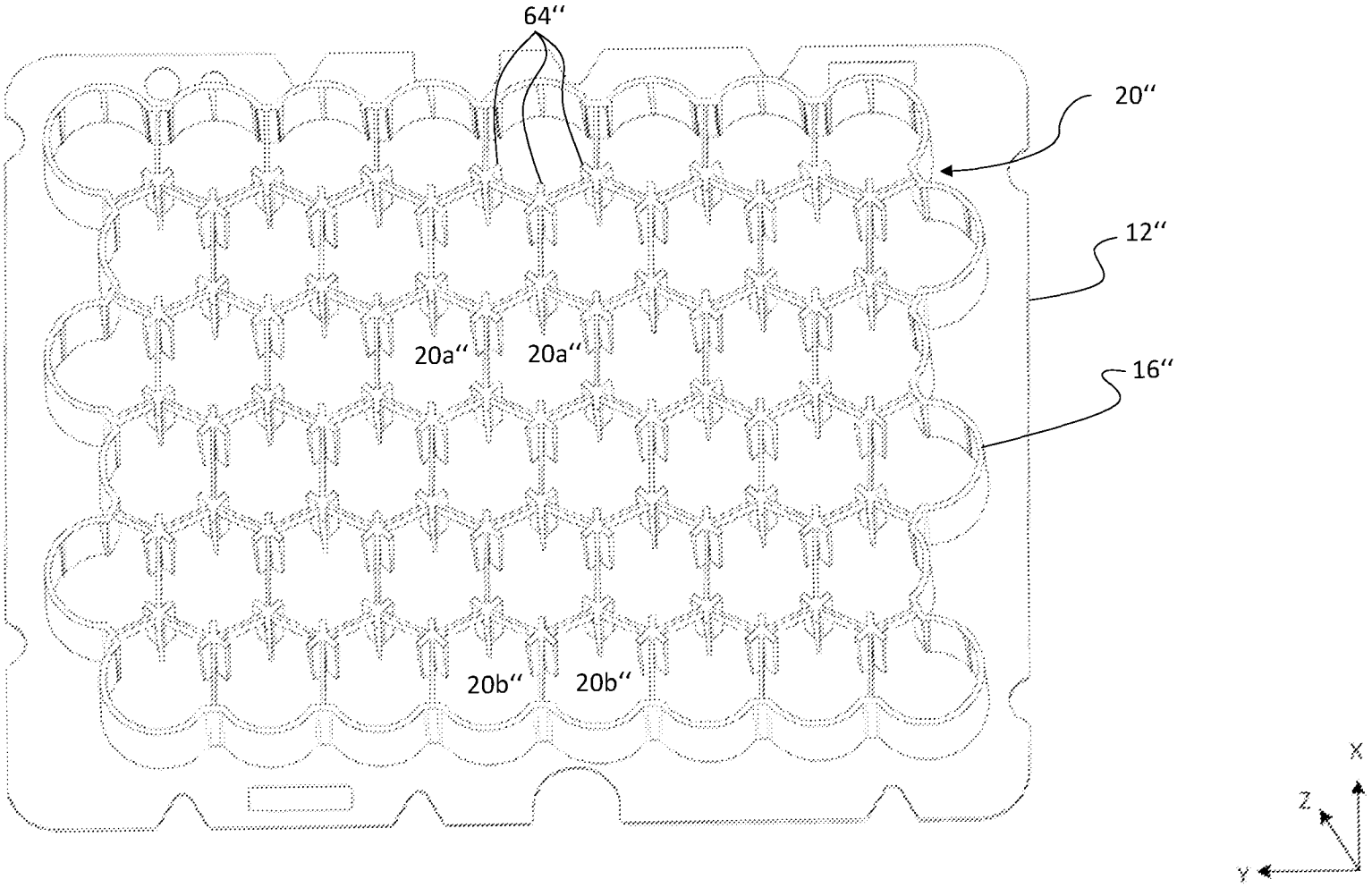

FIG. 13 shows the upper part 12" of FIG. 12 from below. As shown in FIG. 13, the bottom openings 20" of the plurality of sleeves 16" do not necessarily have the same shape across the entire upper part 12". For example, a first type 20*a*" of bottom opening 20" has a substantially hexagonal shape. A second type 20*b*" of bottom opening 20" has a five-sided shape with a mixture of straight and curved sidewalls.

Figure 14A:
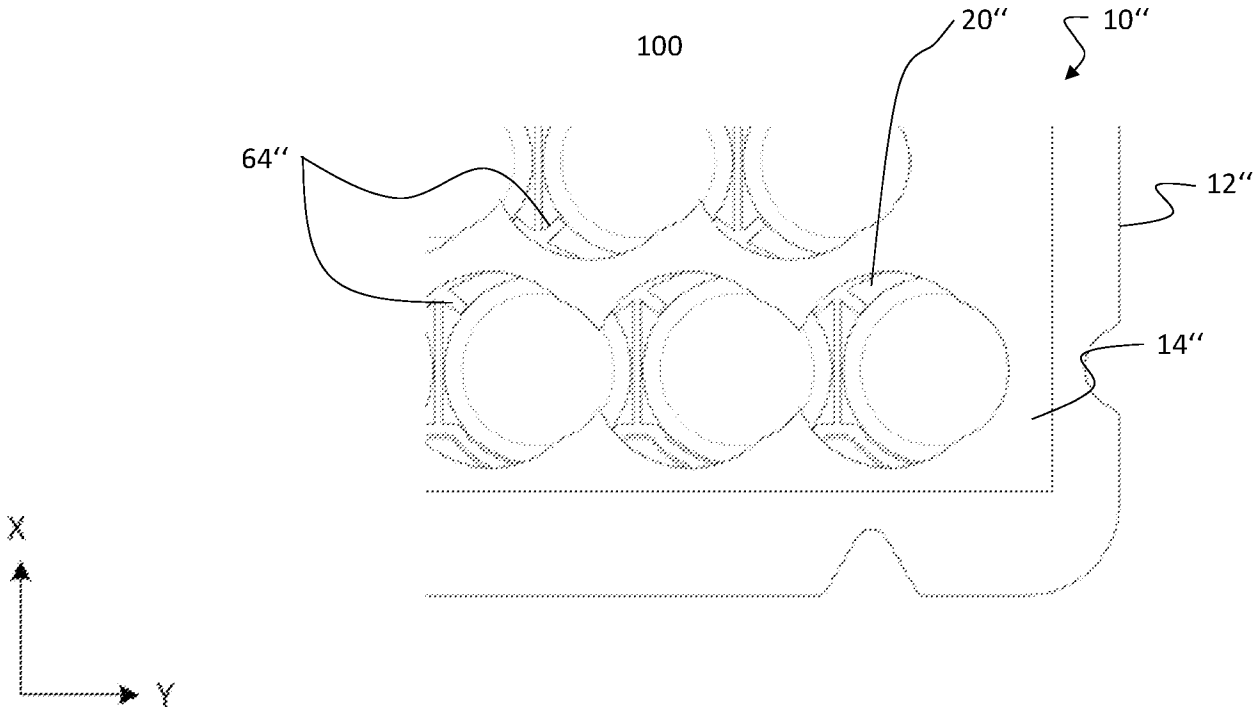
FIGS. 14A and 14B show the transport assembly of FIGS. 12 and 13 in the closed and open configurations, respectively.
Figure 14B:
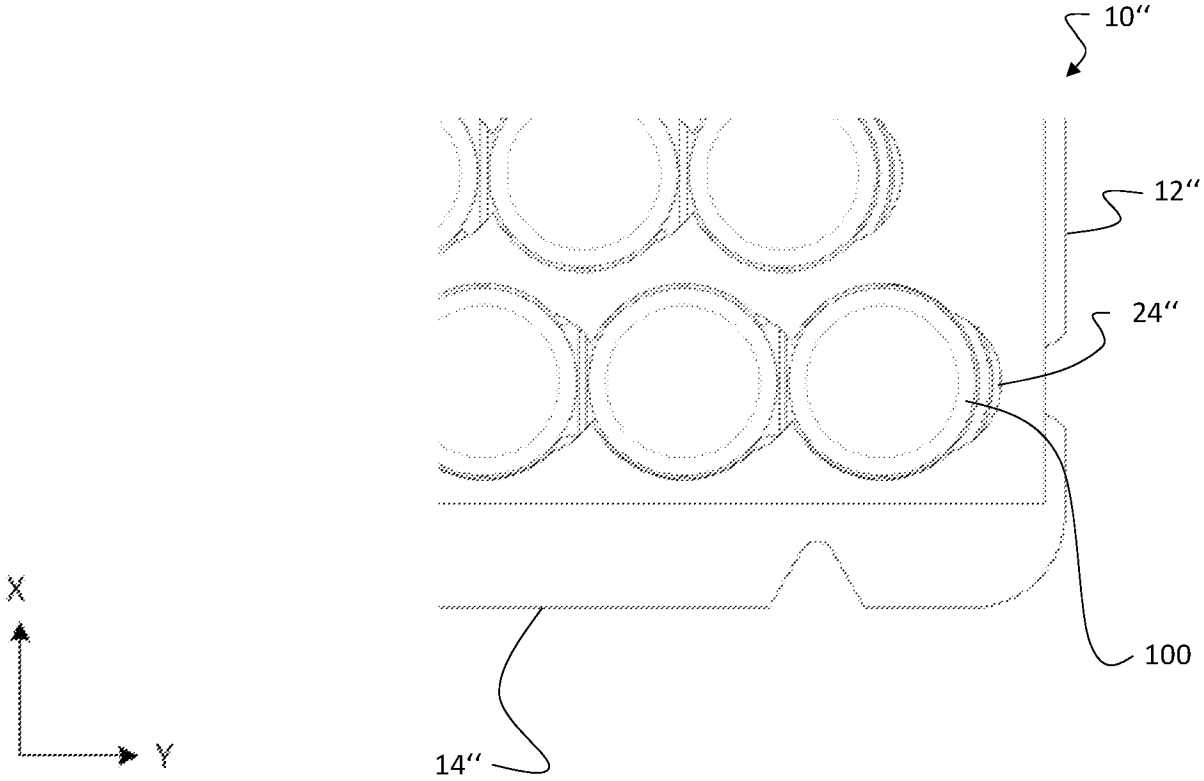

FIGS. 14A and 14B show the transport assembly 10" in the closed and open configurations, respectively. In the transport assembly 10", the sleeves 16" include a plurality of supporting arms 64" that extend into a respective bottom opening 20" (FIG. 13) and designed to support an outer surface of a vial 100 (FIG. 14A). As shown in FIG. 14B, the supporting arms 64" are designed so as not to obstruct the vials 100 from moving through the apertures 24" in the open configuration.

Figure 15:
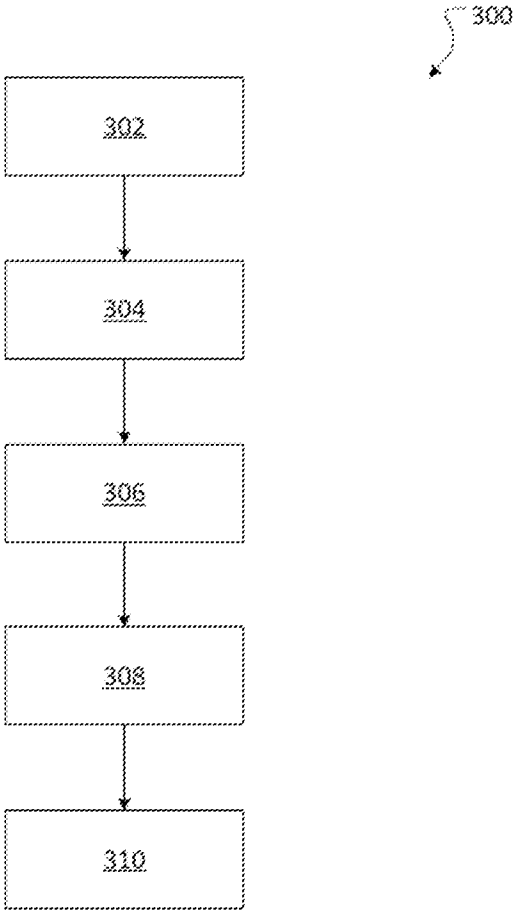
FIG. 15 is a schematic overview of a method according to the present disclosure.

FIG. 15 is a schematic overview of a method 300 according to the present disclosure. For example, the method 300 can be implemented using any of the transport assemblies 10, 10', 10" described above.

The method 300 includes receiving 302 an upper part that comprises a plurality of sleeves, each sleeve extending along a sleeve axis between a top opening and a bottom opening, wherein the plurality of sleeves are arranged with their respective axes in parallel to one another; receiving 304 a lower part that comprises a plate with a plurality of apertures that each extend through the plate; coupling 306 the upper part to the lower part such that each bottom opening is arranged adjacent to one of the plurality of apertures; moving 308 the upper part and the lower part into a closed configuration in which a perimeter of each bottom opening intersects a perimeter of a corresponding aperture at two or more points; and loading 310 a plurality of packaging units in respective sleeves of the upper part, wherein an opening of each container is arranged adjacent to the top opening of the sleeve, and a bottom of each container is arranged adjacent to the bottom opening of the sleeve and supported from below by the lower part. Such a method may arrange the plurality of packaging units (e.g., vials) so that they are ready for transport. For example, the vials and the transport assembly can be placed in a secondary container, such as the container 200 shown in FIG. 1.

The method 300 can include moving the upper part and the lower part into an open configuration in which the perimeter of each bottom opening is aligned with or is enclosed by the perimeter of a corresponding aperture, and moving the bottom of each container through a respective bottom opening and aperture to rest the container on a flat surface. In this way, a plurality of packaging units can be unloaded from the transport assembly at once.

Once the transport assembly is in the open configuration, the transport assembly can be lifted away from the packaging units, which can then be retrieved for further processing steps. In some cases, the packaging units may remain in the transport assembly in this open configuration. For example, the open configuration may be used to expose the bottom of the packaging units to a lyophilization table and improve heat transfer between the lyophilization equipment and the packaging units.

The method 300 can include returning the upper part and the lower part into the closed configuration, such that the lower part is positioned between the bottom of each container and the flat surface. For example, if the packaging units have been placed into contact with a lyophilization table, moving the transport assembly back to the closed configuration may be used to simultaneously "pick up" the plurality of packaging units for further transport and processing. The method 300 can include locking the upper part and the lower part in the closed configuration to prevent relative movement between the upper part and the lower part.

A number of embodiments have been described. Nevertheless, numerous alternative embodiments within the scope of the claims will be readily appreciated by those skilled in the art. The presently described embodiments are not to be taken as limiting the scope of the invention.

The invention claimed is:

1. A transport assembly comprising:

an upper part that comprises a plurality of sleeves arranged in one or more rows, each sleeve extending along a sleeve axis between a top opening and a bottom opening, wherein the plurality of sleeves are arranged with their respective axes in parallel to one another, the upper part comprising a first set of hooks and one or more upper guide surfaces, where one of the one or more upper guide surfaces extends between two adjacent rows of sleeves of the plurality of sleeves; and a lower part that comprises a plate with a plurality of apertures that each extend through the plate, the plurality of apertures are arranged in one or more rows, the lower part comprising one or more lower guide surfaces and comprising a first tab extending from the plate, the first tab comprising a second set of hooks configured to engage the first set of hooks of the upper part, where one of the one or more lower guide surfaces extends between two adjacent rows of apertures of the plurality of apertures, wherein the upper part and the lower part can be slidably coupled such that each bottom opening is arranged adjacent to one of the plurality of apertures, and the upper part and the lower part can be slidably moved relative to one another between:

a closed configuration in which a perimeter of each bottom opening intersects a perimeter of a corresponding aperture at two or more points, and an open configuration in which the perimeter of each bottom opening is aligned with or is enclosed by the perimeter of a corresponding aperture;

wherein each upper guide surface is configured for sliding engagement with a corresponding lower guide surface as the upper part and the lower part move between the closed configuration and the open configuration.

2. The transport assembly according to claim 1, wherein the bottom openings and the apertures have the same shape.

3. The transport assembly according to claim 2, wherein the bottom openings and the apertures are the same size.

4. The transport assembly according to claim 2, wherein the apertures are larger than the bottom openings.

5. The transport assembly according to claim 1, wherein a second of the one or more upper guide surfaces and lower guide surfaces extend along an outer edge of the transport assembly and are spaced apart from the plurality of sleeves.

6. The transport assembly according to claim 1, wherein the lower part comprises a pair of projections arranged on opposite sides of the lower part and configured to abut a respective one of the plurality of sleeves.

7. The transport assembly according to claim 1, wherein an outer edge of the upper part comprises a recessed portion, and wherein an outer edge of the lower part comprises a second tab, wherein the recessed portion and the second tab can be gripped to move the upper part and lower part between the closed configuration and the open configuration.

8. The transport assembly according to claim 1, further comprising a lock that engages when the upper part and lower part are in the closed configuration to prevent relative movement between the upper part and the lower part, the lock comprising:

an indentation formed in the lower part, and a projection formed in the upper part, the indentation being shaped to match the projection.

9. The transport assembly according to claim 1, wherein the upper part comprises a flange arranged adjacent to the top openings of the plurality of sleeves.

10. The transport assembly according to claim 2, wherein the lower part comprises a pair of projections arranged on opposite sides of the lower part and configured to abut a respective one of the plurality of sleeves.

11. The transport assembly according to claim 2, wherein an outer edge of the upper part comprises a recessed portion, and wherein an outer edge of the lower part comprises a second tab, wherein the recessed portion and the second tab can be gripped to move the upper part and lower part between the closed configuration and the open configuration.

12. The transport assembly according to claim 8, wherein the first tab comprises a resilient tongue, the indentation is formed in the resilient tongue, and the projection is formed on an outer peripheral surface of a sleeve of the plurality of sleeves.

13. The transport assembly according to claim 1, wherein:

the upper part further comprises one or more second upper guide surfaces and the lower part further comprises one or more second lower guide surfaces, the one or more second upper guide surfaces extend between second adjacent rows of sleeves of the plurality of sleeves, and the one or more second lower guide surfaces extend between second adjacent rows of apertures of the plurality of apertures, and each second upper guide surface is configured for sliding engagement with a corresponding second lower guide surface as the upper part and lower part move between the closed configuration and the open configuration.

14. A transport assembly comprising:

an upper part that comprises a plurality of sleeves, each sleeve extending along a sleeve axis between a top opening and a bottom opening, wherein the plurality of sleeves are arranged with their respective axes in parallel to one another, the upper part comprising a first set of hooks; and a lower part that comprises a plate with a plurality of apertures that each extend through the plate, the lower part comprising a first tab extending from the plate, the first tab comprising a second set of hooks configured to engage the first set of hooks of the upper part, and the first tab comprising a resilient tongue, wherein the upper part and the lower part can be slidably coupled such that each bottom opening is arranged adjacent to one of the plurality of apertures, and the upper part and the lower part can be slidably moved relative to one another between:

a closed configuration in which a perimeter of each bottom opening intersects a perimeter of a corresponding aperture at two or more points, and an open configuration in which the perimeter of each bottom opening is aligned with or is enclosed by the perimeter of a corresponding aperture; and a lock that engages when the upper part and the lower part are in the closed configuration, the lock configured to prevent relative movement between the upper part and the lower part, the lock comprising:

an indentation formed in the resilient tongue of the lower part, and a projection formed on an outer peripheral surface of a sleeve of the plurality of sleeves in the upper part, the indentation being shaped to match the projection.

* * * * *